US007125288B2

(12) United States Patent
Schilling

(10) Patent No.: US 7,125,288 B2
(45) Date of Patent: Oct. 24, 2006

(54) PREVENTING DAMAGE TO RJ JACKS FROM IMPROPER PLUG INSERTION

(75) Inventor: Robert Schilling, Dolgeville, NY (US)

(73) Assignee: Bel-Fuse Inc., Jersey City, NJ (US)

( * ) Notice: Subject to any disclaimer, the term of this patent is extended or adjusted under 35 U.S.C. 154(b) by 0 days.

(21) Appl. No.: 11/014,286

(22) Filed: Dec. 16, 2004

(65) Prior Publication Data

US 2005/0153580 A1 Jul. 14, 2005

Related U.S. Application Data

(60) Provisional application No. 60/530,447, filed on Dec. 16, 2003.

(51) Int. Cl.
*H01R 24/00* (2006.01)

(52) U.S. Cl. ..... 439/676; 439/660

(58) Field of Classification Search ..... 439/188, 439/660, 676, 677, 680, 681
See application file for complete search history.

(56) References Cited

U.S. PATENT DOCUMENTS 4,556,264 A * 12/1985 Tanaka ..... 439/62
6,220,900 B1 4/2001 Huang ..... 439/676
6,244,907 B1 * 6/2001 Arnett ..... 439/676
6,283,796 B1 9/2001 Yeh ..... 439/677
6,319,070 B1 11/2001 Tan ..... 439/680
6,368,160 B1 * 4/2002 Chang ..... 439/676
6,375,516 B1 4/2002 Trinh ..... 439/680
2002/0009930 A1 1/2002 Chang ..... 439/677
2003/0129880 A1 7/2003 Arnett et al. ..... 439/676
2004/0067693 A1 * 4/2004 Arnett ..... 439/676

* cited by examiner

*Primary Examiner*—Thanh-Tam Le
(74) *Attorney, Agent, or Firm*—Ostrolenk, Faber, Gerb & Soffen, LLP

(57) ABSTRACT

An RJ jack includes a housing having an interior chamber with a plurality of contacts which are deflectable upon insertion of a plug into the chamber. A plurality of projections is provided for limiting the extent of the deflection of selected contacts. In a preferred embodiment, the RJ jack is an RJ45 and the projections are fins located beneath the outermost contacts of the RJ45 jack.

4 Claims, 3 Drawing Sheets

PREVENTING DAMAGE TO RJ JACKS FROM IMPROPER PLUG INSERTION

CROSS REFERENCE TO RELATED APPLICATIONS

This application is based on and claims priority to Provisional Application Ser. No. 60/530,447, filed Dec. 16, 2003 and entitled "RJ11 DAMAGE PREVENTION SCHEME FOR RJ45 JACK," the entire disclosure of which is incorporated herein by reference.

BACKGROUND OF THE INVENTION

The present invention relates to RJ jacks having means for preventing damage to the contacts of the jacks from insertion of non-complementary plugs and, more particularly, to RJ45 jacks having means for preventing damage to the contacts of the RJ45 jacks from insertion of RJ 11 plugs.

An RJ11 connector comprises a six-contact plug and corresponding jack commonly used to connect a communications device such as a telephone, facsimile machine or modem to a telephone line. An RJ45 connector, which is somewhat wider than the RJ11 connector includes eight contacts and is commonly used for Ethernet local area network (LAN) connections.

Referring to FIGS. 1A and 1B there are shown diagrammatic bottom and elevation views, respectively, of an RJ11 plug 10, and referring to FIGS. 2A and 2B there are shown diagrammatic bottom and elevation views, respectively, of an RJ45 jack 12 in insertion alignment with the RJ-11 plug of FIGS. 1A and 1B, with FIG. 2A only showing the contacts 14 of the RJ45 jack 12. The RJ11 plug 11 includes six contact fingers 16 for mating with six contact fingers of an RJ11 jack (not shown). The RJ45 jack 12 includes a housing 18 having an interior chamber 20 with an opening through the front wall through which an RJ45 plug 22 (FIG. 3) may be received into the interior chamber 20. Eight resilient contact fingers 14 are arranged in the chamber 20. The spacing between the jack contact fingers 14 is equal to the spacing of corresponding contacts 26 in the RJ45 plug 22 (FIG. 3).

RJ11 and RJ45 receptacles are often found close to one another, for example, as side-by-side wall jacks in office or other commercial or industrial environments, on computers, on adapters, etc. This proximity can lead to damage to the contacts of the RJ45 jacks.

This is because the RJ11 and RJ45 designs are dimensionally similar, allowing the smaller RJ11 to feign proper mating without any tactile sense of the connection being forced. The results of this all-too-common error are at least damaging and can totally destroy a jack's electrical integrity by permanently crushing its outermost contact fingers.

The root of the problem is that the RJ11 plug is essentially a narrower, six contact version of the eight contact RJ45. Engagement dimensions and contact pitch are common to both. However, the narrower contact region of the RJ11 plug places its body's wide sidewalls 24 (FIG. 1A) directly in line with the outboard contacts 14*a* and 14*h* of the RJ45 jack 12 (FIG. 2A). These contacts 14*a* and 14*h* are designed to hook into relief slots on a mating plug, so the solid sidewalls 22 of the RJ11 tend to crush them during a mating attempt.

Contact force between plug contacts and jack fingers of RJ series connectors is generated by deflecting the inclined, cantilevered, spring fingers of the jack downward as a plug is inserted. For a plug to produce this force, it must enter the jack along a line of action parallel to the planes of the jack's floor and top. Further, the overall height of the plug's body must be only slightly less than the distance between the jack's top and floor so that the top surface of the plug is able to bed against the roof of the jack, thereby insuring that the contacts maintain a fixed height above the jack floor as the upwardly directed force of the fingers grows to more than 100 gms per contact during mating.

As seen in FIG. 3, the contacts 26 of an RJ45 plug 22 are recessed in grooves 28 that keep them typically 0.020" above the base plane of the plug's shell. As shown in FIG. 3, so long as each contact 26 coincides with its corresponding groove 28, proper mating geometry is maintained. However, if, as seen in FIG. 4, a narrower RJ11 plug 10 is pushed into an RJ45 jack opening 20, no contact grooves 28 are presented to receive the outermost fingers 14*a* and 14*h* of the RJ45 jack 12; instead, the shoulders 24 of the RJ11 plug 10 engage the outer fingers 14*a*, 14*h* and, as a result, the fingers are driven down close to the plane of the jack's floor, permanently deforming them.

As used herein, the term "complementary plug" means a plug of the same RJ series as an RJ jack and the term "non-complementary plug" means a plug of a different RJ series than an RJ jack.

SUMMARY OF THE INVENTION

It is an object of the present invention to prevent damage to the contacts of RJ jacks from insertion of non-complementary RJ plugs.

The foregoing and other objects are achieved in accordance with certain features of the invention by an RJ jack comprising a housing having an interior chamber; a plurality of contacts in the chamber, the contacts being deflectable upon insertion of a plug; and means for limiting the extent of the deflection of selected contacts.

Other features and advantages of the present invention will become apparent from the following description of the invention which refers to the accompanying drawings.

DETAILED DESCRIPTION OF PREFERRED EMBODIMENTS OF THE INVENTION

Figure 1A:
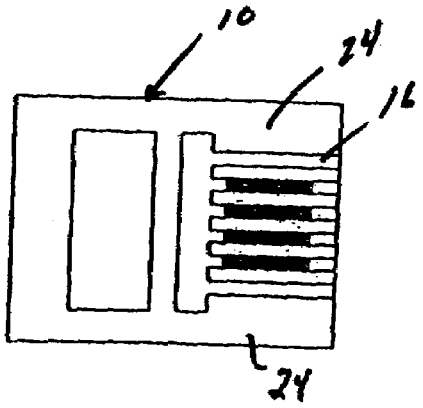
FIG. 1A PRIOR ART
FIGS. 1A and 1B are diagrammatic bottom and elevation views, respectively, of an RJ11 plug.
Figure 2A:
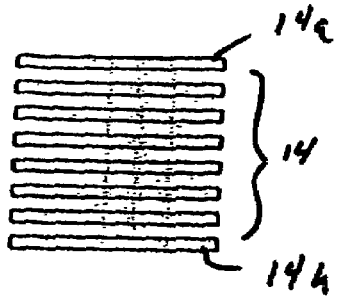
FIG. 2A PRIOR ART
FIGS. 2A and 2B are diagrammatic bottom and elevation views, respectively, of an RJ45 jack in insertion alignment with the RJ-11 plug of FIGS. 1A and 1B, with FIG. 2A only showing the contacts of the RJ45 jack.
Figure 1B:
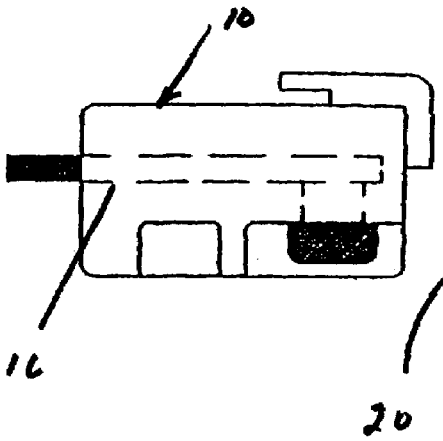
FIG. 1B PRIOR ART
Figure 2B:
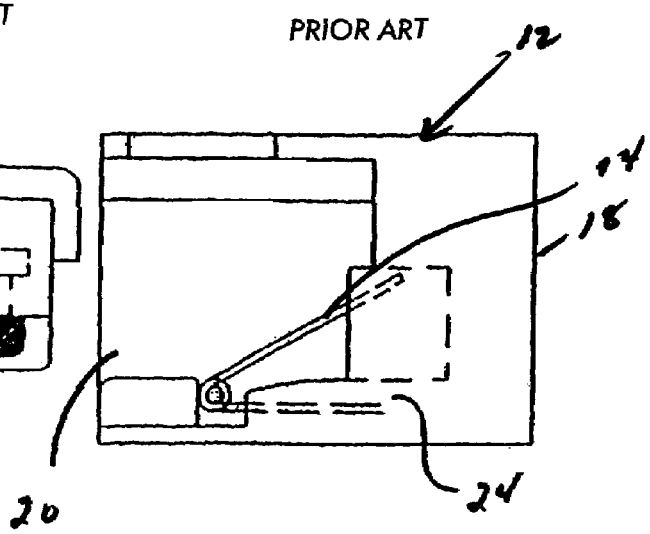
FIG. 2B PRIOR ART
Figure 3:
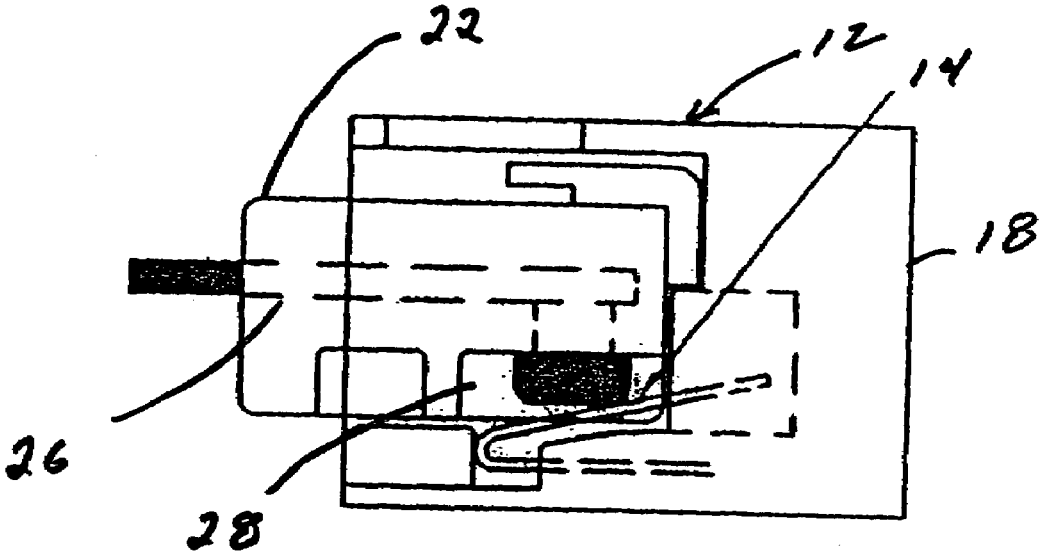
FIG 3 PRIOR ART
FIG. 3 is a diagrammatic elevation view of an RJ45 plug inserted into an RJ45 jack.
Figure 4:
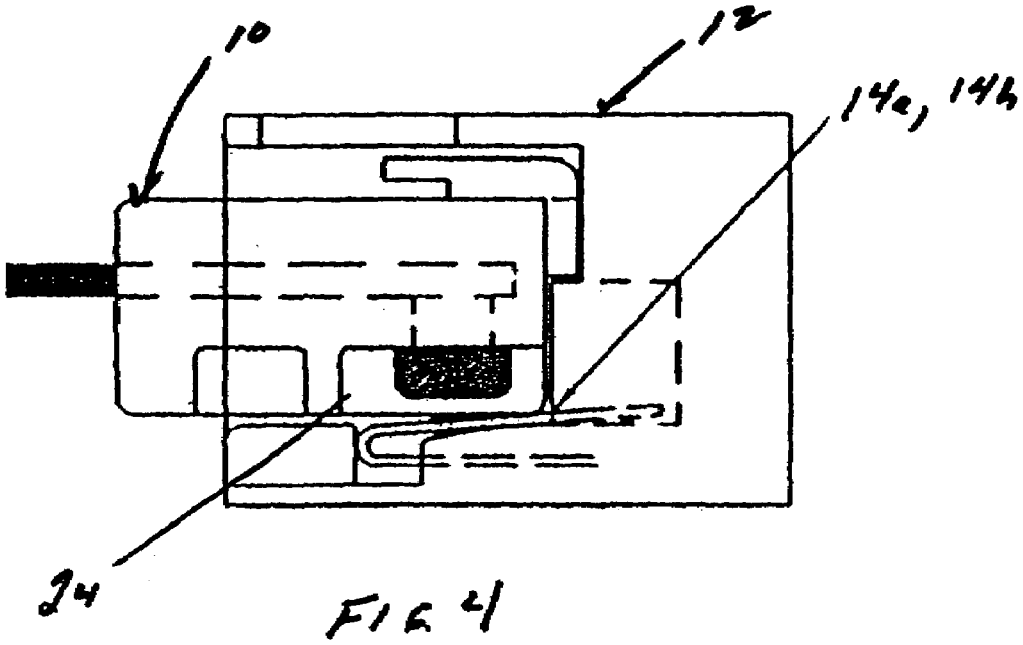
FIG 4 PRIOR ART
FIG. 4 is a diagrammatic elevation view of an RJ11 plug inserted into an RJ45 jack.
Figure 5:
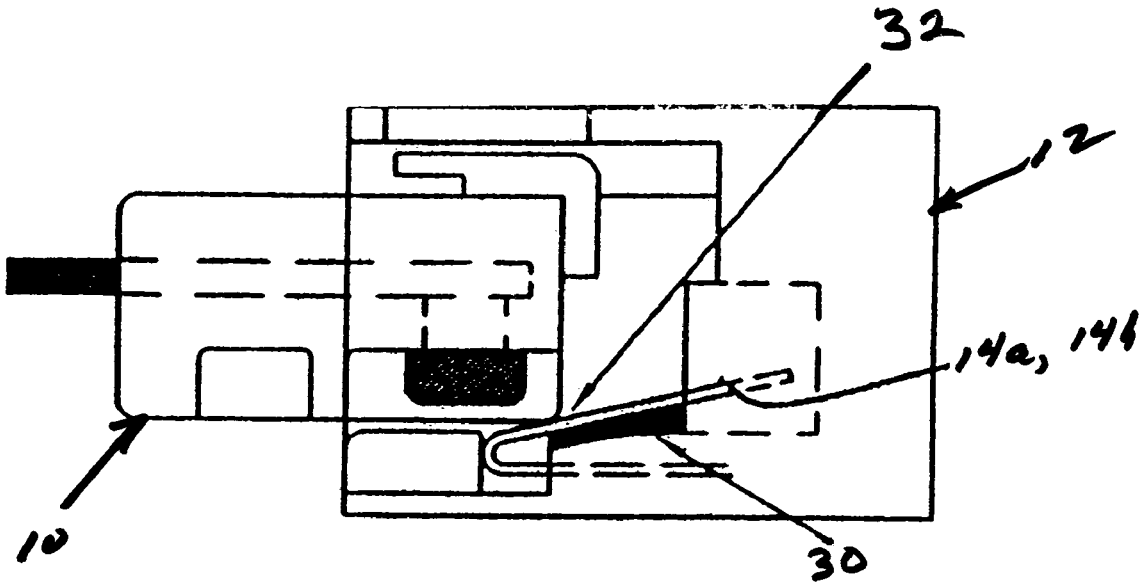
FIG. 5 is a diagrammatic elevation view of an RJ45 jack having means in accordance with certain features of the present invention for preventing damage to the contacts of the RJ45 jack upon the attempted insertion of an RJ11 plug.

Referring to FIG. 5, in accordance with certain features of the present invention, damage to the RJ45jack 12 is prevented by adding two projections, which advantageously may be in the form of triangularly shaped fins 30, behind the two outer fingers 14*a*,14*h* of the RJ45 Jack. The height of the fins 30 is just below the normal height of the fingers 14*a*, 14*h* ,i.e., the top edges of the fins 30 are positioned so that they lie parallel to, and just below, the undersides of the fingers

14*a*, 14*h*, when fingers 14*a*, 14*h* are in their normal, mated position. If an RJ11 plug 10 is inserted, the outer fingers 14*a*, 14*h* will engage the fins 30, causing the plug to jam at the point 32. The resultant resistance to further insertion alerts the user that an RJ11 plug is being mistakenly inserted into an RJ45 jack. On the other hand, when an RJ45 plug is inserted, the slots 24 in the RJ45 plug 22 in the positions corresponding to the two outer fingers 14*a*,14*h* allows normal, damage free mating to occur, i.e., the fingers deflect from an undeflected height to a predetermined deflected height above the floor of the housing. As seen in FIG.5, the fins 30 are formed so that their ramped faces lie parallel to, and just below, the predetermined deflected height, i.e., the anticipated position of the fingers 14*a*, 14*h* when fully deflected by a mated RJ45 plug.

Except for the modifications described herein, the RJ11 plug and the RJ45 jack are conventional. Examples of conventional RJ plugs and jacks may be found in U.S. Pat. Nos. 4,978,317, 5,283,796, 5,319,070, 6,319,070, 6,368,160, 6,375,516, 6.425,781 and U.S. Publication No. 2002/0009930.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An RJ jack, comprising a housing having an interior chamber;

a plurality of contacts in the chamber, the contacts comprising a pair of outermost contacts and at least one middle contact and being deflectable upon insertion of a plug; and a plurality of projections for limiting the extent of the deflection of only the outermost contacts, wherein the outermost contacts have a downward deflection from a non-deflected height to a predetermined deflected height above a floor of the housing and the projections are at a height below the predetermined deflected height.

2. An RJ jack according to claim 1, wherein the projections extend upwardly from the floor.

3. An RJ jack according to claim 2, wherein the projections are triangular fins.

4. An RJ jack according to claim 3, wherein the RJ jack is an RJ45 jack.

* * * * *